US007846535B2

(12) United States Patent
Thiagarajan

(10) Patent No.: US 7,846,535 B2
(45) Date of Patent: Dec. 7, 2010

(54) EDGE STIFFENED POLYMERIC CORRUGATED SHEET MATERIAL

(75) Inventor: Chinniah Thiagarajan, Bangalore (IN)

(73) Assignee: Sabic Innovative Plastics IP B.V. (NL)

( * ) Notice: Subject to any disclaimer, the term of this patent is extended or adjusted under 35 U.S.C. 154(b) by 743 days.

(21) Appl. No.: 11/773,854

(22) Filed: Jul. 5, 2007

(65) Prior Publication Data

US 2009/0011173 A1 Jan. 8, 2009

(51) Int. Cl.

| | |
|---|---|
| ***E04C 2/32*** | (2006.01) |
| ***E04C 2/20*** | (2006.01) |
| ***E06B 3/00*** | (2006.01) |
| ***E06B 3/20*** | (2006.01) |

(52) U.S. Cl. ..... 428/181; 428/182; 428/192; 428/339; 428/174; 49/57; 49/61; 52/202; 52/204.71; 52/204.51; 52/783.18; 52/783.11

(58) Field of Classification Search ..... 428/192, 428/339, 174, 182, 184, 603, 179, 181, 212, 428/213, 218; 52/783.18, 783.11, 783.14; 244/123.12; 261/112.2; 49/57, 61

See application file for complete search history.

(56) References Cited

U.S. PATENT DOCUMENTS

| | | | | |
|---|---|---|---|---|
| 2,853,330 | A * | 9/1958 | Harry | 277/649 |
| 5,579,615 | A | 12/1996 | Hoffman | |
| 5,740,639 | A | 4/1998 | Covington | |
| 5,787,642 | A | 8/1998 | Coyle et al. | |
| 5,855,099 | A | 1/1999 | Hoffman | |
| 5,911,660 | A * | 6/1999 | Watson | 52/202 |
| 5,924,468 | A | 7/1999 | Bisconti | |
| 5,964,052 | A | 10/1999 | Jepsen et al. | |
| 6,025,069 | A | 2/2000 | Eckart et al. | |
| 6,189,264 | B1 | 2/2001 | DiVeroli | |
| 6,243,999 | B1 | 6/2001 | Silverman | |
| 6,296,039 | B1 | 10/2001 | Mullet et al. | |
| 6,737,151 | B1 | 5/2004 | Smith | |
| 2003/0159372 | A1 | 8/2003 | Motro | |
| 2004/0045231 | A1 | 3/2004 | Madden | |
| 2004/0234731 | A1 | 11/2004 | Rinehart et al. | |

(Continued)

OTHER PUBLICATIONS

Article entitled "Testing Application Standard (TAS) 201-94 Impact Test Procedures", Florida Building Code—Test Protocol HVHZ, pp. 1-6.

(Continued)

*Primary Examiner*—Jennifer A Chriss
*Assistant Examiner*—Ricardo E Lopez
(74) *Attorney, Agent, or Firm*—Cantor Colburn LLP

(57) ABSTRACT

Edge stiffened corrugated polymeric sheet material can be utilized as storm panels for mounting about a perimeter surface of an opening so as to protect the opening from wind and impact loads. The panels can include a corrugated sheet material having a corrugated contiguous band horizontally extending at about an end of the top and the bottom, wherein the corrugated contiguous band is complementary and contiguous to the plurality of corrugations of the corrugated sheet panel. The complementary and contiguous corrugated band can be configured to sandwich the sheet material. The panel may also include, individually or in combination, a contiguous band sandwiching the polymeric sheet material at a terminal end of each side and extending vertically from the top to the bottom. The panels provide wind and impact load protection for the opening.

23 Claims, 7 Drawing Sheets

U.S. PATENT DOCUMENTS

| | | | | |
|---|---|---|---|---|
| 2006/0179737 | A1 * | 8/2006 | Trundle | 52/202 |
| 2007/0011962 | A1 | 1/2007 | Erskine | |
| 2007/0113494 | A1 | 5/2007 | Kim et al. | |

OTHER PUBLICATIONS

Article entitled "Testing Application Standard (TAS) 203-94 Criteria for Testing Products Subject to Cyclic Wind Pressure Loading" Florida Building Code—Test Protocol HVHZ, pp. 1-6.

Article entitled "Testing Application Standard (TAS) 202-94 Criteria for Testing Impact & Non Impact Resistant Building Envelope Components Using Uniform Static Air Pressure" Florida Building Code—Test Protocol HVHZ, pp. 1-6.

International Search Report; International Application No. PCT/IB2008/052606; International Filing Date: Jun. 27, 2008; Date of Mailing: Dec. 15, 2008; 6 pages.

Written Opinion of the International Searching Authority; International Application No. PCT/IB2008/052606; International Filing Date: Jun. 27, 2008; Date of Mailing: Dec. 15, 2008; 6 pages.

* cited by examiner

EDGE STIFFENED POLYMERIC CORRUGATED SHEET MATERIAL

BACKGROUND

This disclosure generally relates to an edge stiffened sheet material suitable for use as storm panels.

In areas prone to high winds, e.g., hurricanes, it is common practice to cover any exposed building openings with storm panels. The storm panels are configured to provide wind and impact protection during adverse weather conditions. Desirably, the storm panels provide light transmission and even more desirably, the storm panel as are formed of a sheet material that is optically transparent so as to permit the end user to visually observe the external environment as well as to provide light into the interior in the event of a power outage Corrugated sheet materials are often utilized for storm panels to provide protection during adverse weather conditions. Typically, the corrugated storm panel is mounted over and/or integrated with the opening to be protected. The corrugated storm panels provide protection from wind and impact loads that may be present during the adverse weather conditions.

Configuring a corrugated sheet material as a storm panel to provide sufficient protection is difficult because design parameters for wind and impact loads are generally considered to conflict with one another. Suitable wind load performance generally requires maximum panel stillness where as improvements with regard to impact loads generally require the storm panel to be configured to provide better energy absorption, i.e., have a less stiff structure. Prior art storm panels have attempted to optimize these parameters but are generally deficient in one or both parameters.

Prior art FIG. 1 illustrates a typical storm panel, generally designated by reference numeral 10. The prior art storm panel 10 is formed of a vertically corrugated polymeric sheet 12, which in most instances provides some degree of light transmittance. The sheet 12 is approximately in the shape of a vertically elongated rectangle with vertically extending corrugations 14. The corrugations are generally oriented at a constant pitch, each corrugation 14 being sinusoidal like in shape of a defined length (L) and height (H). The storm panel includes a series of apertures 16, i.e., through holes, at each end for mounting to an opening perimeter. The apertures 16 are generally formed in the trough portions of the corrugations, i.e., the portion of the sheet that contacts the outer perimeter surface of the opening. A threaded screw, bolt or other like fastening member is used to secure the storm panel to the perimeter surface of the opening.

Alternatively, as shown in prior art FIG. 2, the storm panel assembly 20 includes a channel support member 22, e.g., an h-header, which is employed at one of the ends 24, 26, which is commonly formed of lightweight material such as aluminum. The other end (e.g., end 26 in FIG. 2) includes the apertures 16 as discussed above. To install the corrugated storm panel 20, the channel support member 22 is first secured to a surface of the opening perimeter, typically the top surface. One end 24 (without the apertures) of the storm panel is inserted into the channel support member 22. The channel support member typically has a U-shaped channel dimensioned to accommodate the width dimension (i.e., thickness) provided by the corrugations of the storm panel. Once inserted, the other end 26 is secured to the opening perimeter using the apertures 16.

Although the prior art storm panels are suitable for the intended purpose, there remains a need in the art for storm panels that improve upon the performance characteristics of both wind load performance and impact load.

BRIEF SUMMARY

The present disclosure generally provides for panel assemblies suitable for use as storm panels. In one embodiment, a panel assembly for mounting about a perimeter surface of an opening so as to protect the opening from wind and impact loads comprises a corrugated polymeric sheet panel having a plurality of corrugations at a defined and constant pitch, the sheet panel comprising a top, a bottom, and sides therebetween, wherein the corrugations are vertically extending from the top to the bottom; and a corrugated contiguous band horizontally extending at about an end of the top and the bottom, wherein the corrugated contiguous band is complementary and contiguous to the plurality of corrugations of the corrugated sheet panel.

In another embodiment, the panel assembly comprises a corrugated polymeric sheet panel comprising a top, a bottom, and sides therebetween, the corrugated polymeric sheet panel comprising an interior portion having vertically extending corrugations at a defined and constant pitch from the top to the bottom and an outer portion having vertically extending corrugations at a defined and constant pitch from the top to the bottom, wherein the outer portion pitch is less than the interior portion pitch.

In yet another embodiment, the panel assembly comprises a corrugated polymeric sheet panel having a plurality of corrugations at a defined and constant pitch, the sheet panel comprising a top, a bottom, and sides therebetween, wherein the corrugations are vertically extending from the top to the bottom; a contiguous band sandwiching the polymeric sheet material at a terminal end of each side and extending vertically front the top to the bottom; and a corrugated contiguous band horizontally extending at about an end of the top and the bottom, wherein the corrugated contiguous band is complementary and contiguous to the plurality of corrugations of the corrugated sheet panel.

The disclosure may be understood more readily by reference to the following detailed description of the various features of the disclosure and the examples included therein.

BRIEF DESCRIPTION OF THE DRAWINGS

Referring now to the figures wherein the like elements are numbered alike:

PRIOR ART FIG. 1 schematically Illustrates a corrugated storm panel having through holes at each end for securement to an opening perimeter;

Figure 2:
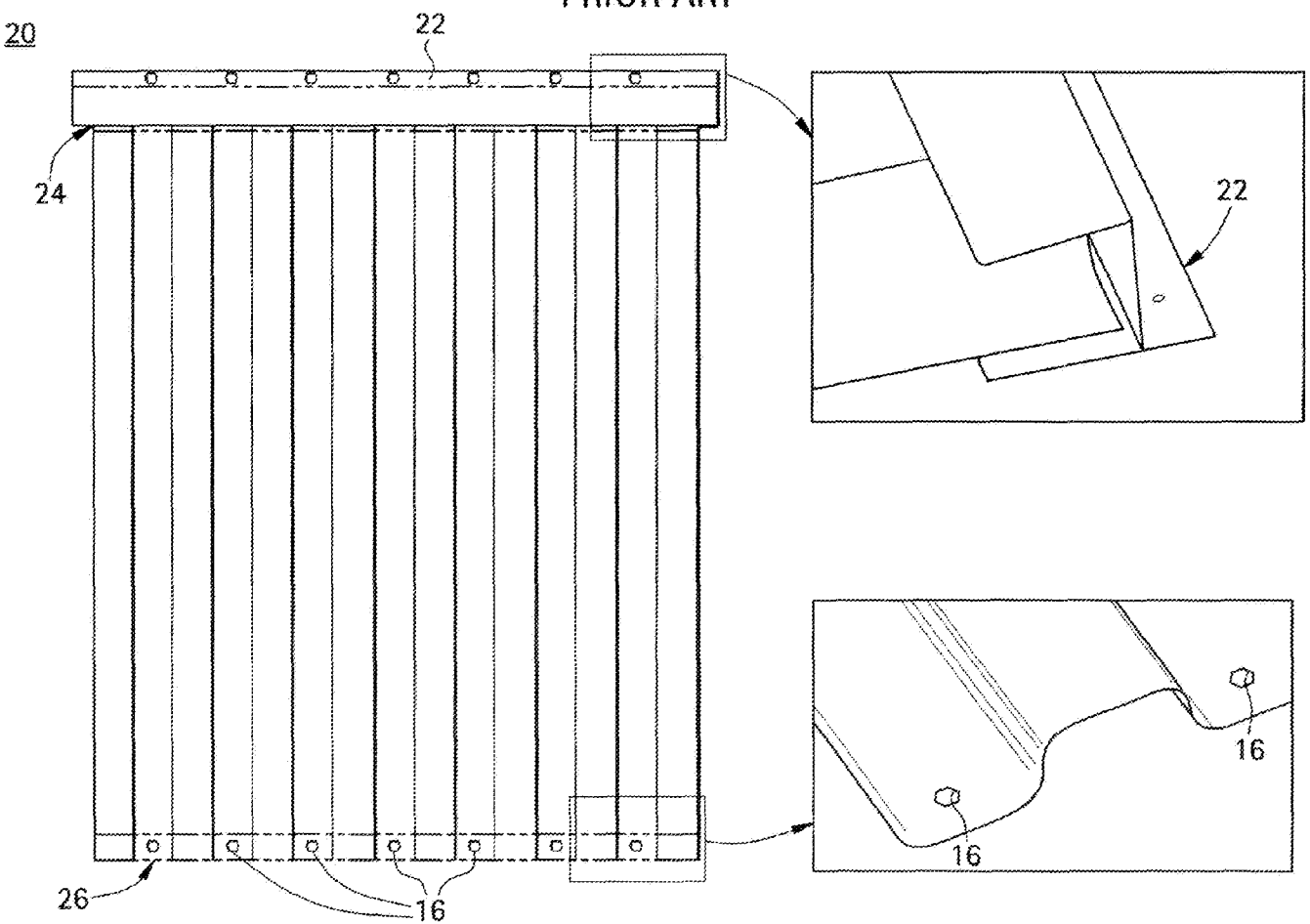
FIG. 2 PRIOR ART
Figure 3:
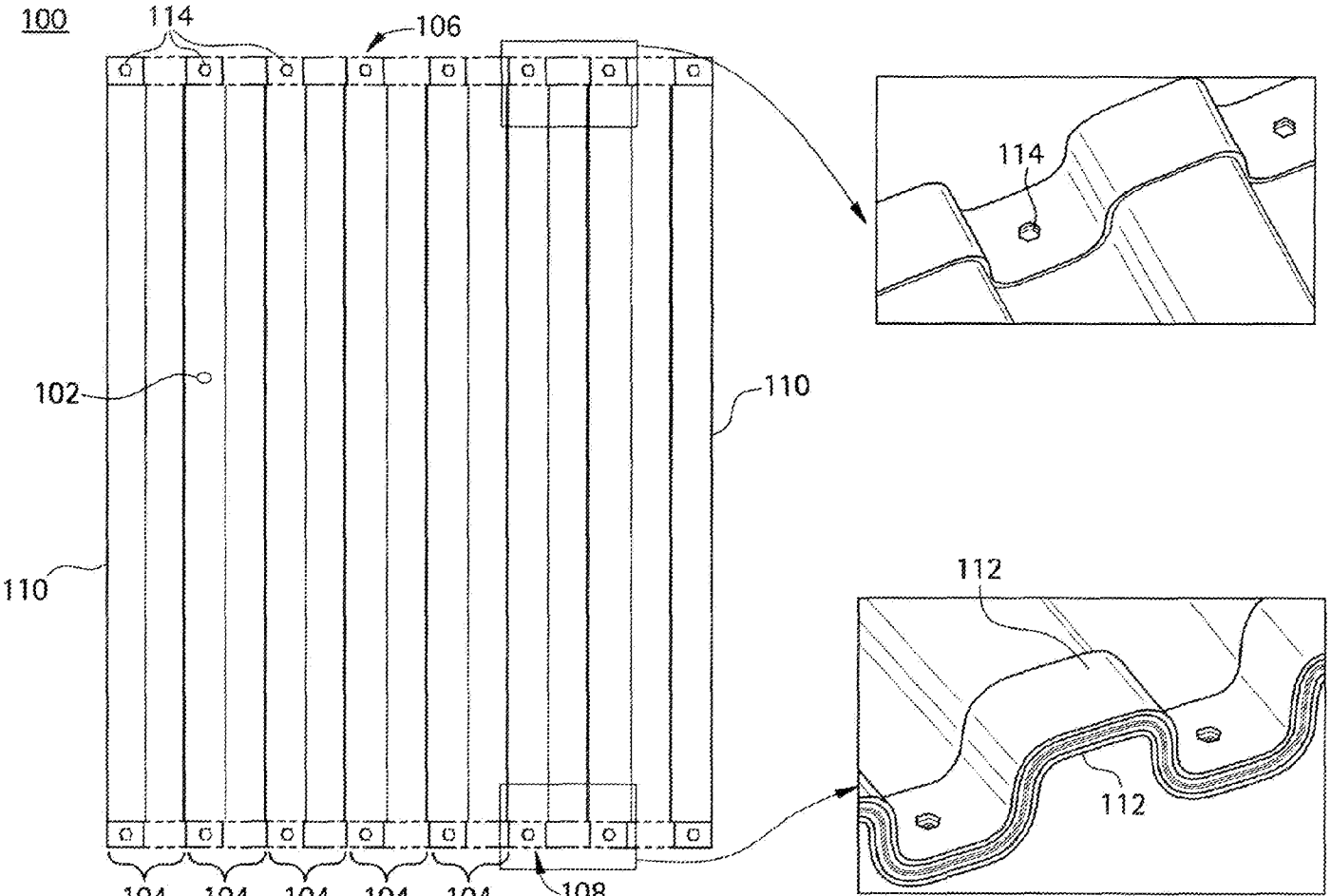
Figure 4:
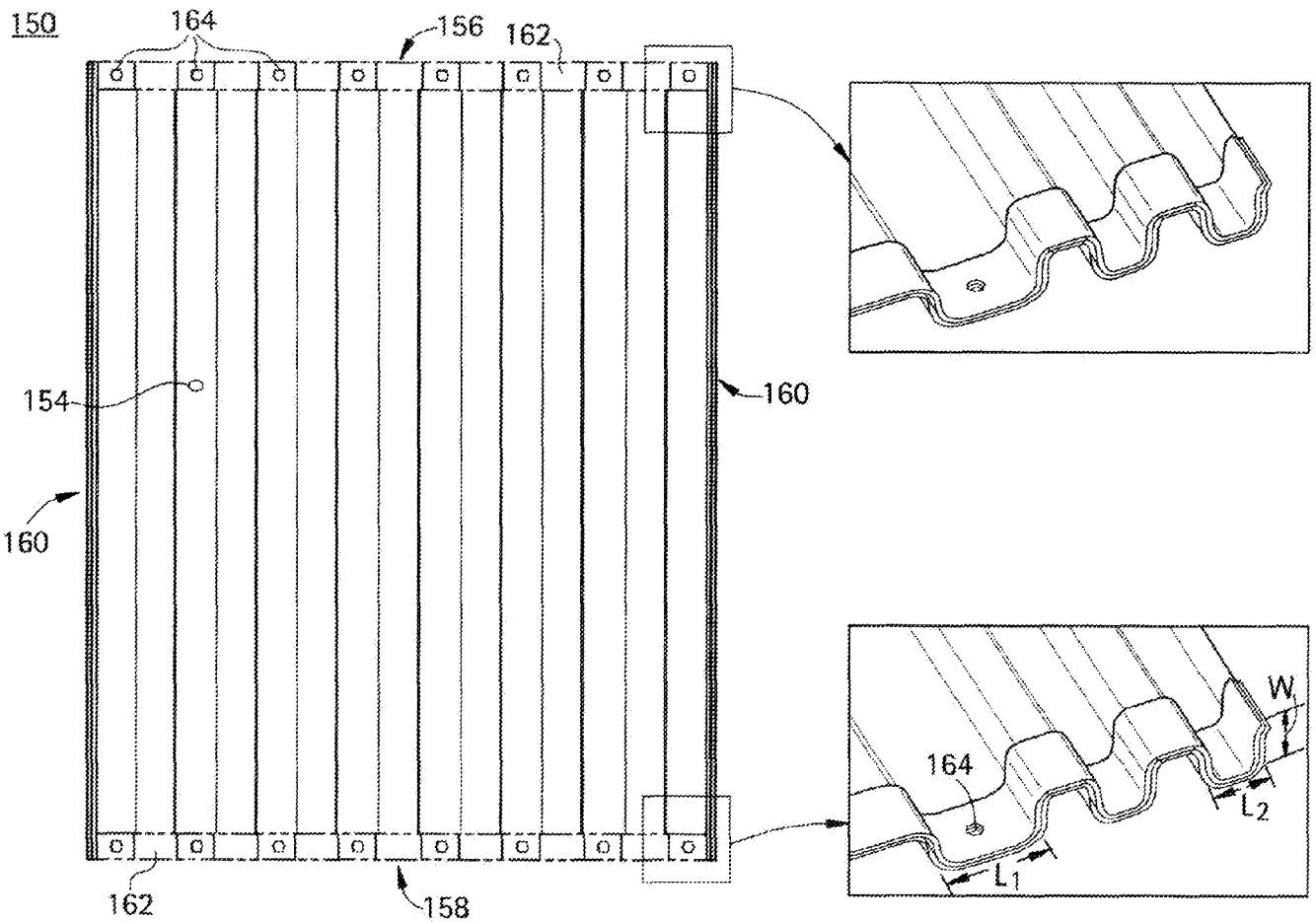
Figure 5:
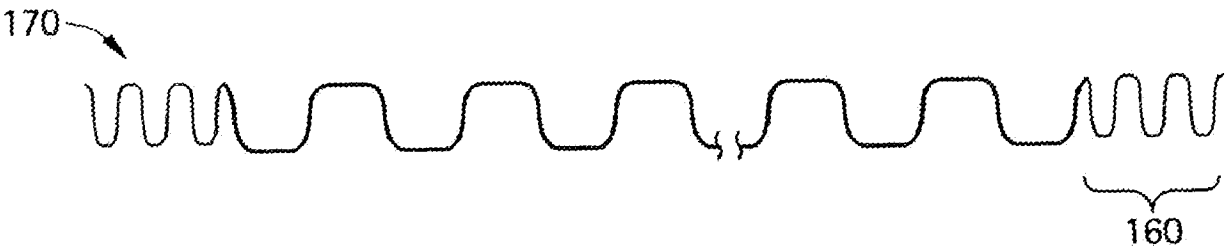
Figure 6:
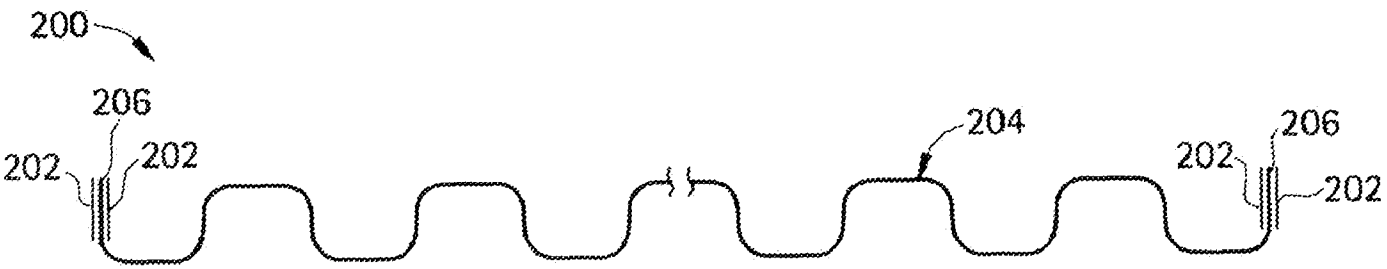
Figure 7:
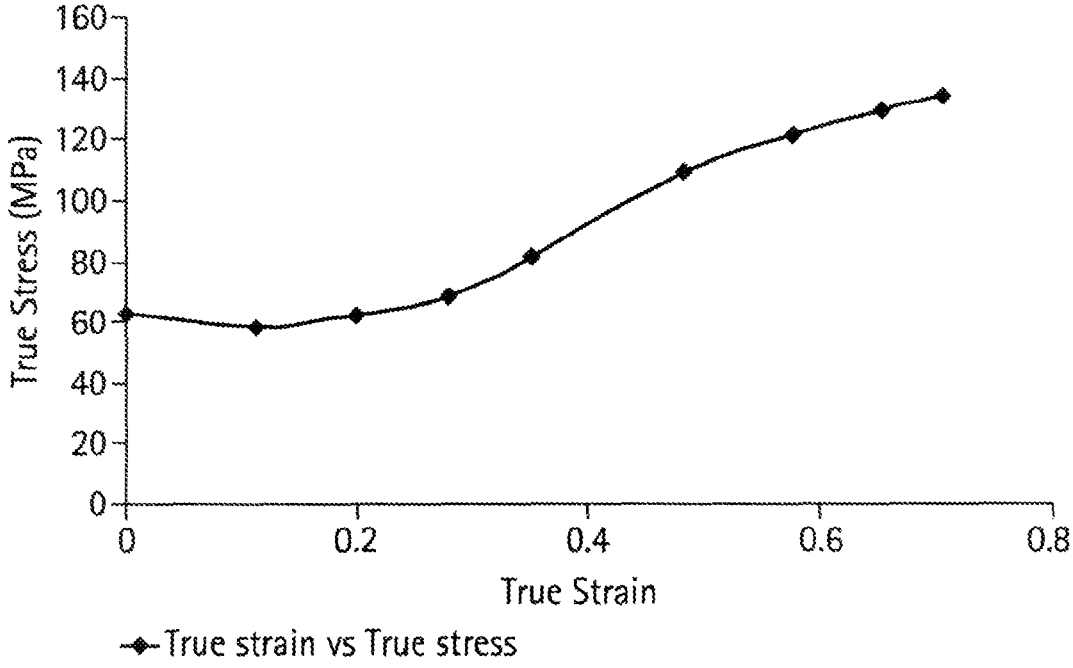
Figure 8:
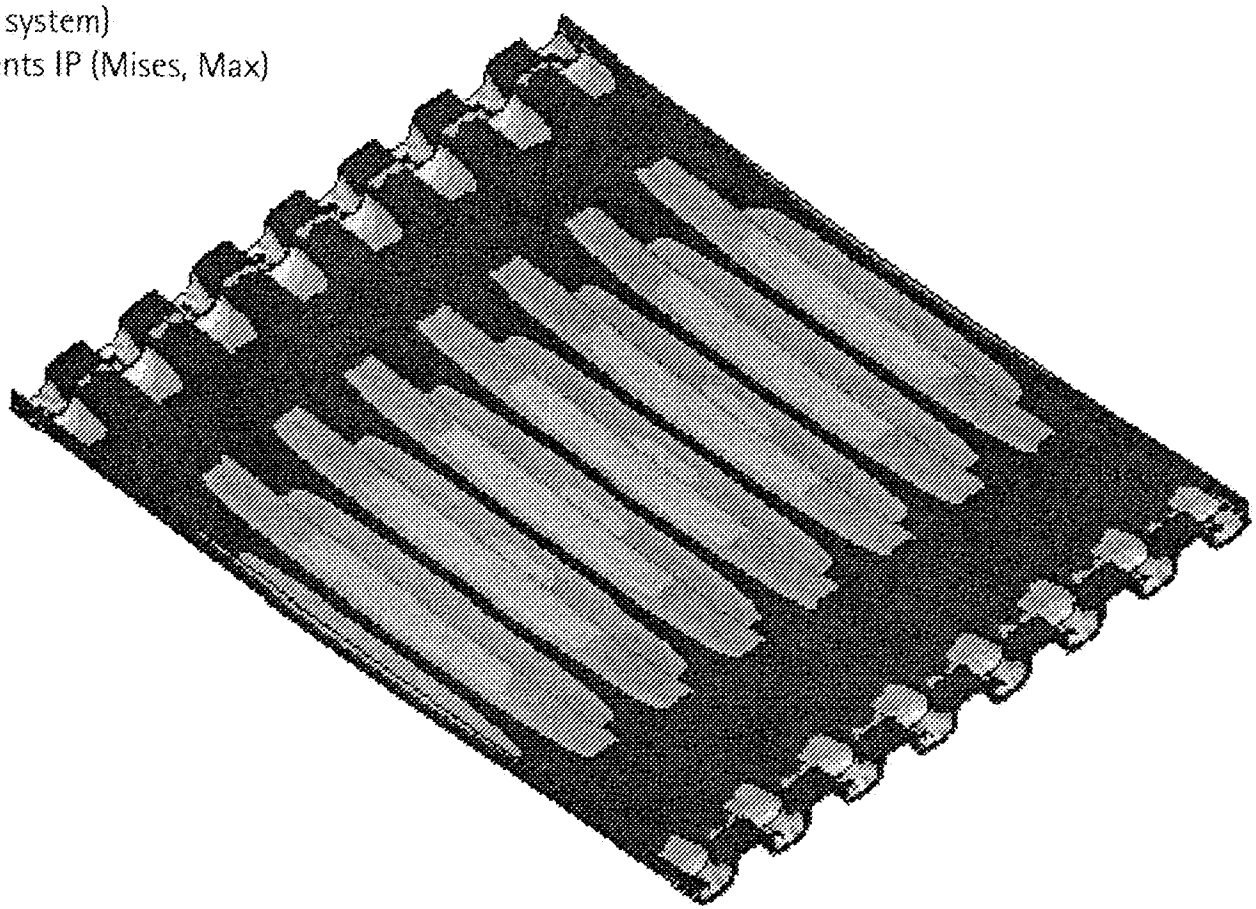

PRIOR ART FIG. 2 schematically illustrates a corrugated storm panel assembly including a corrugate storm panel having through holes at one end and a channel support structure configured to receive and support the other end upon attachment to an opening perimeter;

FIG. 3 schematically illustrates a storm panel assembly in accordance with an embodiment of the disclosure;

FIG. 4 schematically illustrates a storm panel assembly in accordance with an embodiment of the disclosure:

FIG. 5 is a cross section illustrating a corrugation profile in accordance with an embodiment of the disclosure;

FIG. 6 is a cross section illustrating a corrugation profile in accordance with another embodiment of the disclosure;

FIG. 7 graphically illustrates true strain as a function of true stress; and FIG. 8 graphically illustrates a contour plot illustrating wind load analysis of a panel assembly formed in accordance with one embodiment of the disclosure.

DETAILED DESCRIPTION

Disclosed herein are corrugated storm panel assemblies that provide improved wind load and impact load resistance. The storm panels are configured to provide iso-stress distribution of applied loads whether it be storm wind or impact from debris. Referring now to FIG. 3, there is schematically shown a storm panel assembly generally designated by reference numeral 100 configured in accordance with an embodiment of the disclosure. The storm panel is formed of a thermoplastic sheet 102 approximately in the shape of a rectangle with the vertically extending corrugations 104 having a constant pitch. The sheet has a top end 106, a bottom end 108 and sides 110 extending therebetween. The sheet may be formed, for example, from a polycarbonate material or a poly methyl methacrylate (PMMA) material. A particularly suitable example includes the polycarbonate LEXAN® by General Electric. In other embodiments, the polymeric sheet material is reinforced and light transmitting or is of a composite material construction.

At each end 106, 108, a complementary corrugated contiguous band 112 of a rigid material is secured on each side of the corrugated storm panel along the horizontal length of the respective end. The corrugated contiguous band is formed on each side of the sheet to form a sandwich of the polymeric sheet material 102. The rigid material is not intended to be limited. For example, the rigid material can be a metal, a thermoplastic, composite, metal polymer hybrid, or the like. In one embodiment, the rigid material is polycarbonate. Apertures 114 are formed through the contiguous bands and the polymeric sheet to provide a means for securing the storm panel 100 to a surface defining an opening perimeter.

In one embodiment, the thickness of the complementary corrugated contiguous band is 1 to 10 times the thickness of the polymeric sheet material 102. In other embodiments, the thickness of the complementary corrugated contiguous band is 1 to 3 times the thickness of the polymeric sheet material 102. The width of the band is 2 to 10 times the diameter of the bolt used to secure these sheets. In still other embodiments, the width is 1 to 3 times the diameter of the bolt, i.e., aperture 114, used to secure these sheets.

FIG. 4 illustrates storm panel assembly 150 configured in accordance with another embodiment. The storm panel is formed of a thermoplastic sheet 154 approximately in the shape of a rectangle with the vertically extending corrugations 162 having a constant pitch. The sheet has a top end 156, a bottom end 158 and sides 160 extending therebetween. Each side of the corrugated sheet includes corrugations having a smaller pitch than the interior portion. That is the length dimension ($L_1$) of the interior corrugations is less than length dimension ($L_2$) of the outer portions (sides) of the corrugated sheet, wherein the width dimension remains constant. The corrugation pitch at the outer portion can be varied or constant. The number or period of corrugations at the side having the smaller pitch can vary. In one embodiment, the number of corrugations at the outer portion is greater than 1 and less than 20. In other embodiments, greater than 2 to less than 10, and in still other embodiments, greater than 2 to less than 5. In one embodiment, the density of corrugation $L_1$ is greater than $L_2$.

For additional support, the storm panel can optionally include a corrugated contiguous band at each end in the manner described in relation to FIG. 4. Apertures 104 are disposed at each end 156, 158.

FIG. 5 provides a cross section of an exemplary corrugation profile 170 for the storm panel of FIG. 4. Bach side 160 includes a corrugation pitch that is smaller than the pitch of the interior portion of the corrugated sheet.

In another embodiment shown in FIG. 6, the storm panel 200 includes a contiguous band 202 disposed on each side of the polymeric sheet at a terminal end 206 of each side of the corrugated sheet 204 and vertically extending from the top to the bottom of the sheet. The vertically extending contiguous bands have been found to improve impact and wind load resistance. In one embodiment, the thickness is 1 to 10 times the thickness of the polymeric sheet material 102. In other embodiments, the thickness of the complementary corrugated contiguous band is 1 to 3 times the thickness of the polymeric sheet material 102. The width is generally less than the height dimension of the corrugation. Optionally, the ends (not shown can be additionally configured with contiguous bands in the manner provided in FIG. 4.

The shape of the corrugations and contiguous bands thereon are not intended to be limited to any particular shape. For example, the corrugations can have a square shape, a round shape, a triangular shape, a truncated triangular shape, a sinusoidal shape, polygonal shape, a truncated isosceles triangular shape, irregular shapes, and the like. Likewise, the storm panels can be transparent, semi-opaque or opaque depending on the desired application. The storm panels can be used in various other applications including, without limitation, window systems, building openings, shelter openings, rooting, signage, impact resistant structures, and the like.

In addition, the corrugated sheets shown in one or more of the embodiments may be provided with a coating layer thereon, depending upon the particular desired application thereof. For example, the polycarbonate material of the outer walls may be provided with an ultraviolet (UV) ray protective layer, an optical transmission enhancement layer, a self-cleaning layer, acoustic damping layer, or combinations thereof.

Extrusion, thermoforming, injection molding, and the like can form the corrugated polymeric sheet material as well as the contiguous layers disposed thereon. In those embodiments utilizing contiguous layers, any means can be utilized to bond the contiguous layer to the corrugated sheet material including but not limited to, an adhesive, solvent, thermoplastic welding, ultrasonic welding, vibration welding, laser welding, any electro magnetic method of bonding, and the like. Alternatively, edge stiffening cats be provided by integral profile extrusion process, wherein the contiguous corrugated band is co-extruded with the corrugated sheet material.

Building products are often rated in accordance with testing application standards (TAS) such as Florida Building Code standards TAS-201, TAS-202, and TAS 203. TAS 201 (ASTM E1886 and E1996) provides standardized impact test procedures for measuring impact loads. Parameters such as maximum deflection and permanent deformation are recorded. For window applications, compliant sheet material should withstand an impact from a 9 pound weight wood of dimension of 2"×4"×8" impact at as impact speed of around 40 to 80 feet per sec (at a impact speed of 50 feet per sec, the impact load is around 350 ft/lbs) without any penetration. TAS 202 (ASTM E330 and E1996) details the criteria or testing impact and non impact resistant building envelope components using uniform static air pressure, impact and cyclic loading conditions. Desirably, the sheet deflection should be less than 2 inches or less than length span divided by 30 (L/30), whichever is less. TAS 203 details the criteria for testing products subject to cyclic wind pressure loading. Desirably, at least 600 cycles should be obtained for window applications, H has been found that the above storm panels meet and exceed these standards. Based on simulation results, the storm panels configured in accordance with the present disclosure to provide, during wind loads, a maximum deflection of less than 50 millimeters without any plastic strain and a maximum von Mises stress less than the ultimate tensile stress of the material (which is 65 $N/mm^2$ (Newtons per square millimeter) for LEXAN) was indicated. During impact load testing, no penetration of the impactor was expected, maximum von Mises stress was less than the ultimate tensile stress of 65 $N/mm^2$ and plastic strain is less than ¼ the failure strain (e.g., 25% for LEXAN). The von Mises stress is often used to estimate the yield of ductile materials and states that failure occurs when the stress level reaches the same stress level for onset of yield/failure in uni-axial tension. In other words, the thickness and width of the corrugated bands, whether it be for the complementary and corrugated bands employed at the ends and/or at the terminal ends of the sides, be effective to comply with these parameters.

The disclosure is explained in more detail with reference to the following non-limiting Examples, which are intended to be illustrative, not limitative.

EXAMPLES

Example 1

Figure 1:
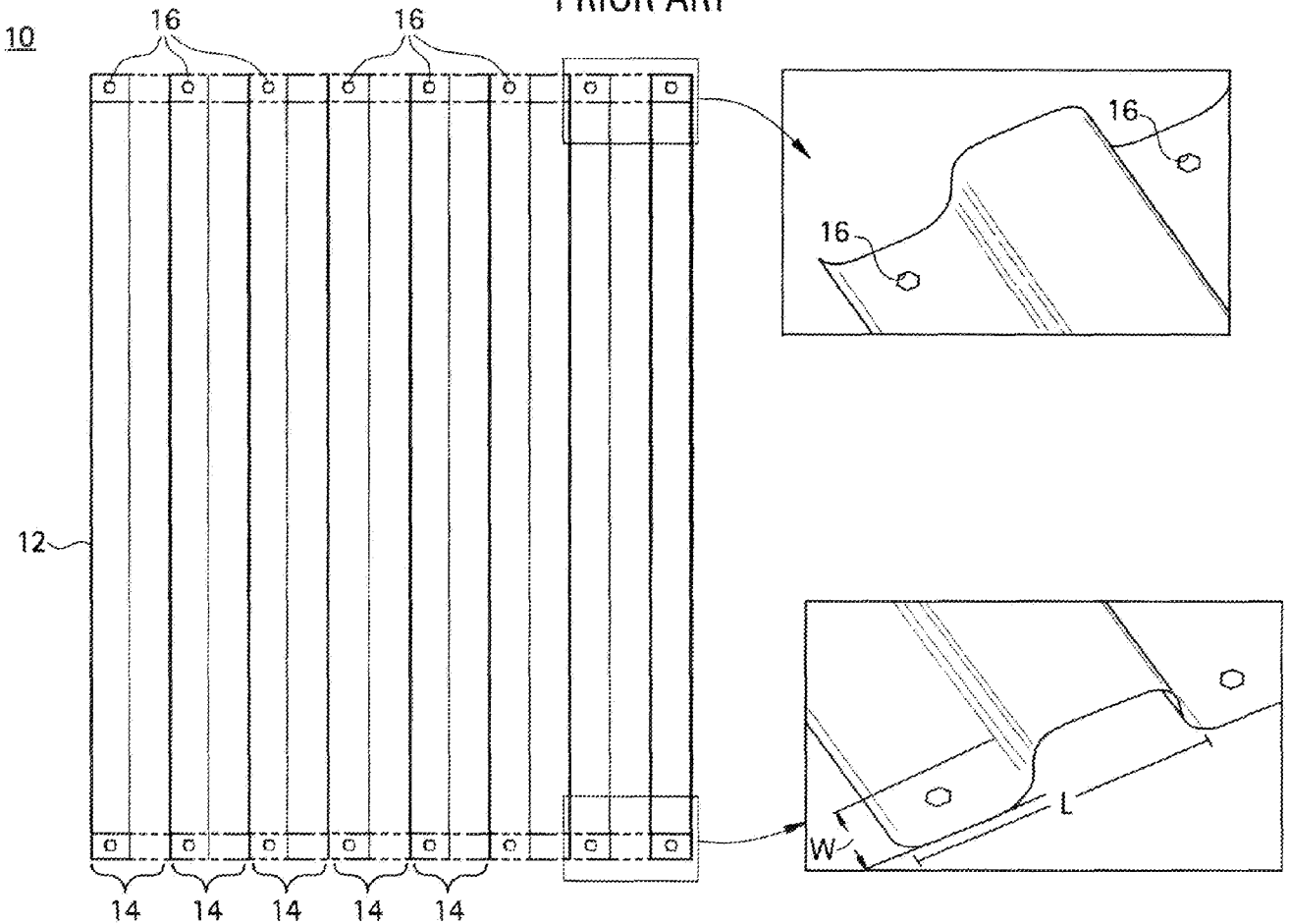
FIG. 1 PRIOR ART

In this example, wind and impact load performance was simulated for various configurations. Simulation was made using ABAQUSTM , version 6.6 industry standard finite element software program. General purpose S4 shell elements were used. The coefficient of friction was 0.3. Also, in the impactor simulation, the impactor is assumed to be a rigid body. The sheet material and the contiguous bands are formed from polycarbonate (LEXAN). The polycarbonate had an E of 2400 MPa and a Nu of 0.38. An elasto plastic material model is used. A typical true stress strain behavior after yield is shown in FIG. 7. Table 1 provides wind load simulation results and Table 2 provides impact load simulation results. Examples 1 and 2 are comparative and correspond to prior art FIGS. 2 and 1, respectively. Examples 3a and 3b correspond to the storm panel of FIG. 4. Examples 4a and 4b correspond to FIGS. 5 and 6, respectively, and include the complementary corrugated contiguous band.

TABLE 1

| Ex. No. | Model Details | Wind Load (N/m2) | Max. Deflection (mm) | Max. Von Mises stress (MPa) | Plastic Strain (%) | Boundary Condition |
|---|---|---|---|---|---|---|
| 1* | Bottom side is bolted; top side is inserted into 5 inch h-header | Pr/3638.9 | 155.20 | 62.50 | 12.28 | One-side bolted |
| 2* | Top and bottom sides are bolted onto a hard support | Pr/3638.9 | 48.44 | 62.50 | 0.17 | Bolted |
| 3a | Top and bottom sides are bolted with 3 mm LEXAN corrugated profile | Pr/3638.9 | 50.08 | 67.38 | 25.63 | Bolted |
| 3b | Top and bottom sides are bolted with 6 mm LEXAN corrugated profile | Pr/3638.9 | 46.75 | 48.05 | 0.00 | Bolted |
| 4a | Top and bottom sides are bolted with 6 mm LEXAN with corrugated profile and variable pitched sides | Pr/3638.9 | 31.57 | 44.98 | 0.00 | Bolted |
| 4b | Top and bottom sides are bolted with 6 mm LEXAN and 4 mm edge stiffener | Pr/3638.9 | 31.73 | 45.40 | 0.00 | Bolted |

*comparative example
Pr-pressure loading
Su-suction
Pop-UP-y direction of deflection
Total-z direction of deflection

TABLE 2

| Impact performance | | | | | | |
|---|---|---|---|---|---|---|
| Ex. No. | Model Details | Impact Energy (Joules) | Max. Deflection (mm) | Max. Von Mises stress (MPa) | Plastic Strain (%) | Boundary Condition |
| 1 | Bottom side is bolted; top side is inserted into 5 inch header | 470.9 | 218.40 | 78.53 | 37.85 | One-side bolted |

TABLE 2-continued

| Impact performance | | | | | | |
|---|---|---|---|---|---|---|
| Ex. No. | Model Details | Impact Energy (Joules) | Max. Deflection (mm) | Max. Von Mises stress (MPa) | Plastic Strain (%) | Boundary Condition |
| 2 | Top and bottom sides are bolted onto a hard support | 470.9 | 189.50 | 97.42 | 44.12 | Bolted |
| 3a | Top and bottom sides are bolted with 3 mm LEXAN corrugated profile | 470.9 | 187.80 | 98.31 | 42.65 | Bolted |
| 3b | Top and bottom sides are bolted with 6 mm LEXAN corrugated profile | 470.9 | 187.80 | 75.57 | 30.92 | Bolted |
| 4a | Top and bottom sides are bolted with 6 mm LEXAN with corrugated profile and variable pitched sides | 470.9 | 187.50 | 61.86 | 18.31 | Bolted |
| 4b | Top and bottom sides are bolted with 6 mm LEXAN and 4 mm edge stiffener | 470.9 | 180.90 | 62.48 | 19.52 | Bolted |

Wind and impact load significantly improved relative to the comparative examples.

Example 2

In this example, a wind and impact load simulation was made comparing a storm panel formed of polycarbonate including a 6 mm contiguous corrugated band formed of polycarbonate (LEXAN) at each end and a 4 mm contiguous band formed of polycarbonate at the wing portion as shown in FIGS. 4 and 6. The thicknesses of the corrugated sheet was the same for each storm panel, which were both formed from polycarbonate (LEXAN). The numerical simulation was performed using the ABAQUS™ version 6.6. Software with suitable element, material model and analysis procedure. Table 3 provides the simulation results.

TABLE 3

| | | Maximum Deflection (mm) | | | | Max. | |
|---|---|---|---|---|---|---|---|
| | Wind Load ($Nm^2$) | In-plane (x) | Pop-UP | Total | Deflection Mid-sheet | von Mises stress | Equivalent Plastic Strain (%) |
| Baseline | Pr/3638.9 | 5.88 | 4.49 | 48.44 | 44.99 | 62.50 | 62.50 |
| | Su/3638.9 | 8.08 | 1.89 | 43.53 | 21.33 | 62.50 | 2.45 |
| | Central impact | 0.47 | 19.44 | 189.50 | 189.50 | 97.42 | 44.12 |
| 6 mm contiguous corrugated band at ends; 4 mm polycarbonate contiguous band at side wing portions | Pr/3638.9 | 2.71 | 2.62 | 31.73 | 31.73 | 45.40 | 0 |
| | Su/3638.9 | 4.04 | 1.43 | 19.13 | 19.13 | 36.69 | 0 |
| | Central impact | 0.71 | 15.3 | 180.9 | 180.9 | 62.48 | 19.52 |

The results shown in Table 1 clearly demonstrate a significant improvement during wind load simulation. Von Muses stress and equivalent plastic strains were significantly decreased relative to the baseline. For example, stress upon center impact was 87.12 whereas plastic strain was 40.31%. In comparison, the baseline exhibited a corner impact stress of 114.80 and a plastic strain of 51.93%. In FIG. 8, a contour plot of stress was made of the edge stiffened panel as described. As shown therein, iso-stress distribution of the stress was observed in the simulation.

Advantageously, the unique configurations of the storm panels provide a 30 to 100% improvement in protection against severe wind and impact loads relative to the prior art configurations noted above. Moreover, the storms panels can be made transparent so as to provide optical visibility. Performance improvement is provided by a unique iso-stress design. During wind loads, the panels are configured to provide a maximum defection of less than 50 millimeters (mm), and a maximum Von Mises stress of less than an ultimate stress of the polymeric sheet material without any plastic strain. During impact loads, the panels are configured to provide no penetration of the impactor, a maximum Von Mises stress loading less than an ultimate stress of the polymeric sheet material (e.g., less than 65 $N/mm^2$ for LEXAN) and a plastic strain of less than ¼ of the failure strain of the polymeric sheet material (less than 25% for LEXAN). Still further, the panel assemblies are relatively lightweight when compared to prior art panel assemblies that include structural reinforcements, e.g., mesh screens, the use of channels, cross bars, and the like.

Ranges disclosed herein are inclusive and combinable (e.g., ranges of "up to about 25 wt %, or, more specifically, about 5 wt % to about 20 wt %", is inclusive of the endpoints and all inner values of the ranges of "about 5 wt % to about 25 wt %" etc.), "Combination" is inclusive of blends, mixtures, derivatives, alloys, reaction products, and so forth, furthermore, the terms "first," "second," and so forth, herein do not denote any order, quantity, or importance, hut rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g. includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and can or can not be present in other embodiments, in addition, it is to be understood that the described elements can be combined in any suitable manner in the various embodiments.

All cited patents, patent applications, and other references are incorporated herein by reference hi their entirety. However, if a term in the present application contradicts or conflicts with a term in the incorporated reference the term from the present application takes precedence over the conflicting term from the incorporated reference.

While typical embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

What is claimed is:

1. A panel assembly for mounting about a perimeter surface of an opening so as to protect the opening from wind and impact loads, the panel comprising:

a corrugated polymeric sheet panel comprising a top, a bottom, and sides therebetween, wherein the corrugated polymeric sheet panel comprises an interior portion having corrugations, wherein the corrugations are vertically extending from the top to the bottom and wherein the corrugations have a defined and constant interior portion pitch from the top to the bottom and wherein a side of the corrugated polymeric sheet panel comprises corrugations, wherein the corrugations are vertically extending from the top to the bottom and wherein the corrugations have a defined and constant side pitch from the top to the bottom; wherein the side pitch is less than the interior portion pitch; and a corrugated contiguous band horizontally extending at about an end of the top and the bottom, wherein the corrugated contiguous band is complementary and contiguous to the plurality of corrugations of the corrugated sheet panel.

2. The panel assembly of claim 1, wherein the polymeric sheet panel is formed of a polycarbonate.

3. The panel assembly of claim 1, wherein the complementary and corrugated contiguous band is disposed on each major surface of the sheet panel.

4. The panel assembly of claim 1, wherein the polymeric sheet material is light transmitting.

5. The panel assembly of claim 1, wherein the complementary and corrugated contiguous band is formed of a thermoplastic.

6. The panel assembly of claim 1, wherein the complementary and corrugated contiguous band is formed of a polycarbonate.

7. The panel assembly of claim 1, further comprising a contiguous band sandwiching the polymeric sheet material at terminal end of each side and extending vertically from the top to the bottom.

8. The panel assembly of claim 1, wherein the panel is configured to provide during wind loads a maximum deflection of less than 50 millimeters, and a maximum von Mises stress loading less than an ultimate stress of the polymeric sheet material without any plastic strain; and during an impact load, no penetration of an impactor, a maximum von Mises stress loading less than the ultimate stress of the polymeric sheet material, and a plastic strain of less than ¼ of the failure strain of the polymeric sheet material.

9. The panel assembly of claim 1, wherein the polymeric sheet material is reinforced and light transmitting.

10. The panel assembly of claim 1, wherein the polymeric sheet material is a composite material construction.

11. The panel assembly of claim 1, wherein each one of the plurality of corrugations have a shape selected from a group consisting of a square shape, a round shape, a triangular shape, a truncated triangular shape, a truncated isosceles triangular shape, a sinusoidal shape, a polygonal shape, and combinations thereof.

12. A panel assembly for mounting about a perimeter surface of an opening so as to protect the opening from wind and impact loads, the panel assembly comprising:

a corrugated polymeric sheet panel comprising a top, a bottom, and sides therebetween, the corrugated polymeric sheet panel comprising an interior portion having vertically extending corrugations at a defined and constant interior portion pitch from the top to the bottom and an outer portion having vertically extending corrugations at a defined and constant outer portion pitch from the top to the bottom, wherein the outer portion pitch is less than the interior portion pitch.

13. The panel assembly of claim 12, further comprising a corrugated contiguous band horizontally extending at about an end of the top and the bottom, wherein the corrugated contiguous band is complementary and contiguous to the interior and outer corrugations of the corrugated sheet panel.

14. The panel assembly of claim 12, wherein the panel is configured to provide during wind loads a maximum deflection of less than 50 millimeters, and a maximum von Mises stress of less than an ultimate stress of the polymeric sheet material without any plastic strain; and during an impact load, no penetration of an impactor, a maximum von Mises stress loading of less than the ultimate stress of the polymeric sheet material, and a plastic strain of less than ¼ of the failure strain of the polymeric sheet material.

15. The panel of claim 12, wherein the corrugated polymeric sheet panel is formed of a polycarbonate.

16. The panel of claim 13, wherein the complementary and corrugated contiguous band is disposed on each major surface of the polymeric sheet panel.

17. The panel of claim 12, wherein the outer portion of the polymeric sheet material have greater than 1 and less than 20 corrugations.

18. The panel assembly of claim 12, wherein the polymeric sheet material is light transmitting.

19. The panel assembly of claim 13, wherein the complementary and corrugated contiguous band is formed of a thermoplastic.

20. The panel assembly of claim 12, wherein the panel assembly is configured to provide an isotropic stress distribution for wind and impact loads.

21. A panel assembly for mounting about a perimeter surface of an opening so as to protect the opening from wind and impact loads, the panel comprising:

a corrugated polymeric sheet panel comprising a top, a bottom, and sides therebetween, wherein the corrugated polymeric sheet panel comprises an interior portion having corrugations, wherein the corrugations are vertically extending from the top to the bottom and wherein the corrugations have a defined and constant interior portion pitch from the top to the bottom and wherein a side of the corrugated polymeric sheet panel comprises corrugations, wherein the corrugations are vertically extending from the top to the bottom and wherein the corrugations have a defined and constant side pitch from the top to the bottom; wherein the side pitch is less than the interior portion pitch; a contiguous band sandwiching the polymeric sheet material at a terminal end of each side and extending vertically from the top to the bottom; and a corrugated contiguous band horizontally extending at about an end of the top and the bottom, wherein the corrugated contiguous band is complementary and contiguous to the plurality of corrugations of the corrugated sheet panel.

22. The panel assembly of claim 21, wherein the polymeric sheet panel is formed of a polycarbonate.

23. The panel assembly of claim 21, wherein the panel is configured to provide during wind loads a maximum deflection of less than 50 millimeters, and a maximum von Mises stress of less than an ultimate stress of the polymeric sheet material without any plastic strain; and during an impact load, no penetration of an impactor, a maximum von Mises stress loading of less than the ultimate stress of the polymeric sheet material, and a plastic strain of less than ¼ of the failure strain of the polymeric sheet material.

* * * * *